US005956985A

United States Patent [19]

Chang

[11] Patent Number: 5,956,985

[45] Date of Patent: Sep. 28, 1999

[54] MULTI-FUNCTION KEY HOLDER

[76] Inventor: Gin-Sung Chang, No. 229-21, Kuang-Ming Rd., Chien-Chu Tsun, Wu-Jin Hsiang, Taichung Hsien, Taiwan

[21] Appl. No.: 09/189,419

[22] Filed: Nov. 10, 1998

[51] Int. Cl.[6] ..... A47G 29/10

[52] U.S. Cl. ..... 70/456 R; 116/DIG. 1; 359/803

[58] Field of Search ..... 70/456 R; 7/168; 206/37.1, 38.1; 359/803, 809; 116/307, DIG. 1, DIG. 39

[56] References Cited

U.S. PATENT DOCUMENTS

| | | | |
|---|---|---|---|
| 1,838,494 | 12/1931 | Neuwirth | 359/817 X |
| 2,630,212 | 3/1953 | Mosch | 70/456 R |
| 2,745,244 | 5/1956 | Friedli | 70/456 R |
| 3,640,108 | 2/1972 | Cairns | 70/456 R |
| 4,574,505 | 3/1986 | Chiodo | 359/817 X |
| 4,660,397 | 4/1987 | Girimont | 70/456 R |
| 4,903,514 | 2/1990 | Jung | 70/456 R |
| 5,058,405 | 10/1991 | Stillwagon | 70/456 R |

*Primary Examiner*—Lloyd A. Gall
*Attorney, Agent, or Firm*—Ladas & Parry

[57] ABSTRACT

The casing of a multi-function key holder has a front casing portion which includes parallel top and bottom parts that extend forwardly and that are spaced apart vertically to define a lens receiving space therebetween, and a rear casing portion which extends rearwardly from the front casing portion and which confines an air chamber. The rear casing portion is formed with an air inlet adapted to permit blowing of air into the air chamber, and an air outlet adapted to permit releasing of the air that was blown into the air chamber, thereby permitting generation of a whistling sound output. A planar magnifying lens piece is disposed in the lens receiving space, and has an edge section mounted pivotally on the front casing portion. The lens piece is movable between a concealed position, where the lens piece is confined between the top and bottom parts of the front casing portion, and an extended position, where the lens piece is exposed from the top and bottom parts of the front casing portion. A key chain has a key holding end adapted for holding a bunch of keys thereon, and a mounting end opposite to the key holding end and mounted on the casing.

14 Claims, 3 Drawing Sheets

MULTI-FUNCTION KEY HOLDER

BACKGROUND OF THE INVENTION

1. Field of the Invention

The invention relates to a key holder, more particularly to one having multiple functions.

2. Description of the Related Art

A conventional key holder includes a key chain having a key holding end that is adapted for holding a bunch of keys thereon. In some key holders, a toy, such as a doll, is attached to an opposite mounting end of the key chain for aesthetic purposes. In other key holders, a tag is attached to the mounting end of the key chain for advertisement purposes. To increase the functions of the key holder, it has been proposed heretofore to attach other devices, such as a whistle, a foldable knife or a flashlight, to the mounting end of the key chain. It is desirable to provide a key holder that incorporates a number of functions without involving a substantial increase in its dimensions.

SUMMARY OF THE INVENTION

Therefore, the main object of the present invention is to provide a multi-function key holder that incorporates the functions of a magnifying lens and a whistle.

Another object of the present invention is to provide a multi-function key holder that further incorporates the functions of a compass and a thermometer.

According to the present invention, a multi-function key holder comprises a casing, a planar magnifying lens piece and a key chain.

The casing has a front casing portion which includes parallel top and bottom parts that extend forwardly and that are spaced apart vertically to define a lens receiving space therebetween, and a rear casing portion which extends rearwardly from the front casing portion and which confines an air chamber. The rear casing portion is formed with an air inlet adapted to permit blowing of air into the air chamber, and an air outlet adapted to permit releasing of the air that was blown into the air chamber, thereby permitting generation of a whistling sound output.

The lens piece is disposed in the lens receiving space, and has an edge section mounted pivotally on the front casing portion. The lens piece is movable between a concealed position, where the lens piece is confined between the top and bottom parts of the front casing portion, and an extended position, where the lens piece is exposed from the top and bottom parts of the front casing portion.

The key chain has a key holding end adapted for holding a bunch of keys thereon, and a mounting end opposite to the key holding end and mounted on the casing.

Preferably, the top part of the front casing portion has an upper side formed with a receiving cavity, and a compass is mounted in the receiving cavity. In addition, the casing has a bottom side formed with a positioning cavity, and a thermometer is mounted in the positioning cavity.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
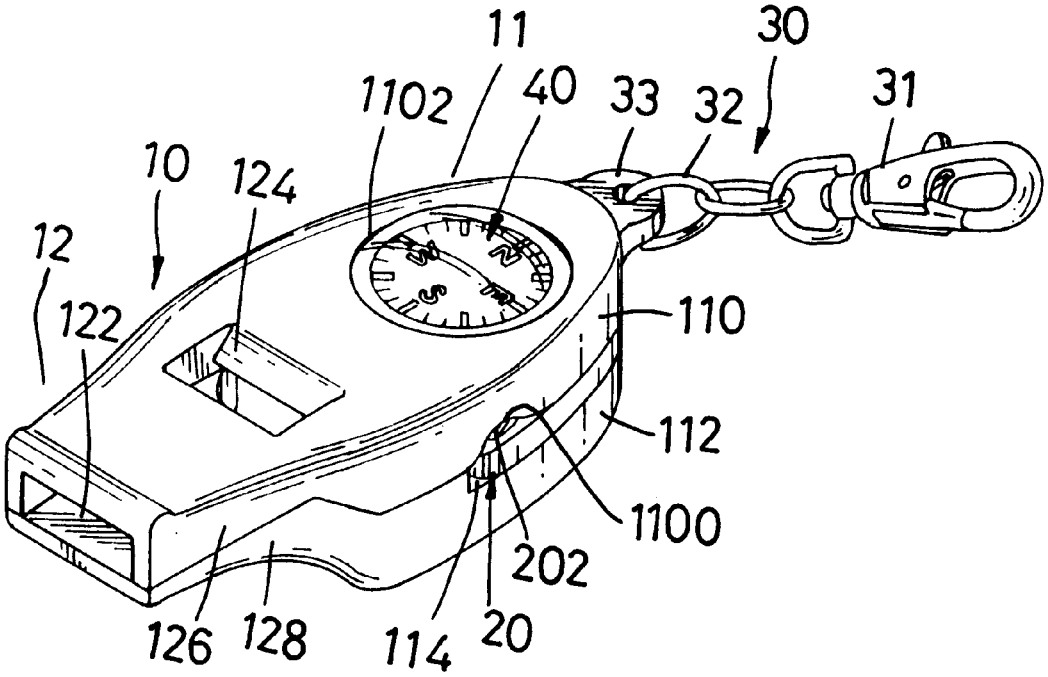
FIG. 1 is an assembled perspective view of the preferred embodiment of a multi-function key holder according to the present invention.
Figure 3:
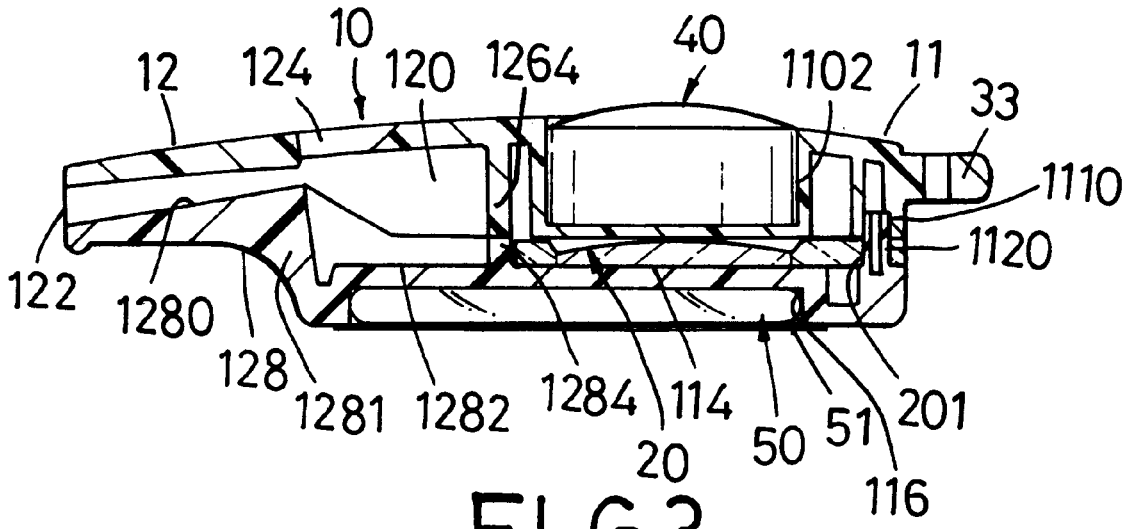
FIG. 3 is a longitudinal sectional view of the preferred embodiment.

Referring to FIG. 1, the preferred embodiment of a multi-function key holder according to the present invention is shown to comprise a casing 10 having a front casing portion 11 which includes parallel top and bottom parts 110, 112 that extend forwardly and that are spaced apart vertically to define a lens receiving space 114 therebetween, and a rear casing portion 12 which extends rearwardly from the front casing portion 11 and which confines an air chamber 120 (see FIG. 3). The rear casing portion 12 is formed with an air inlet 122 for blowing air into the air chamber 120, and an air outlet 124 for releasing the air that was blown into the air chamber 120, thereby permitting generation of a whistling sound output. The casing 10 has a longitudinal axis that extends from the front casing portion 11 to the rear casing portion 12, and the air inlet 122 is disposed on the longitudinal axis at one end of the rear casing portion 12 distal to the front casing portion 11. The rear casing portion 12 includes upper and lower parts 126, 128 having front ends that are connected to the front casing portion 11 and rear ends that cooperatively define the air inlet 122. The air outlet 124 is transverse to the longitudinal axis, and is formed in the upper part 126.

Figure 2:
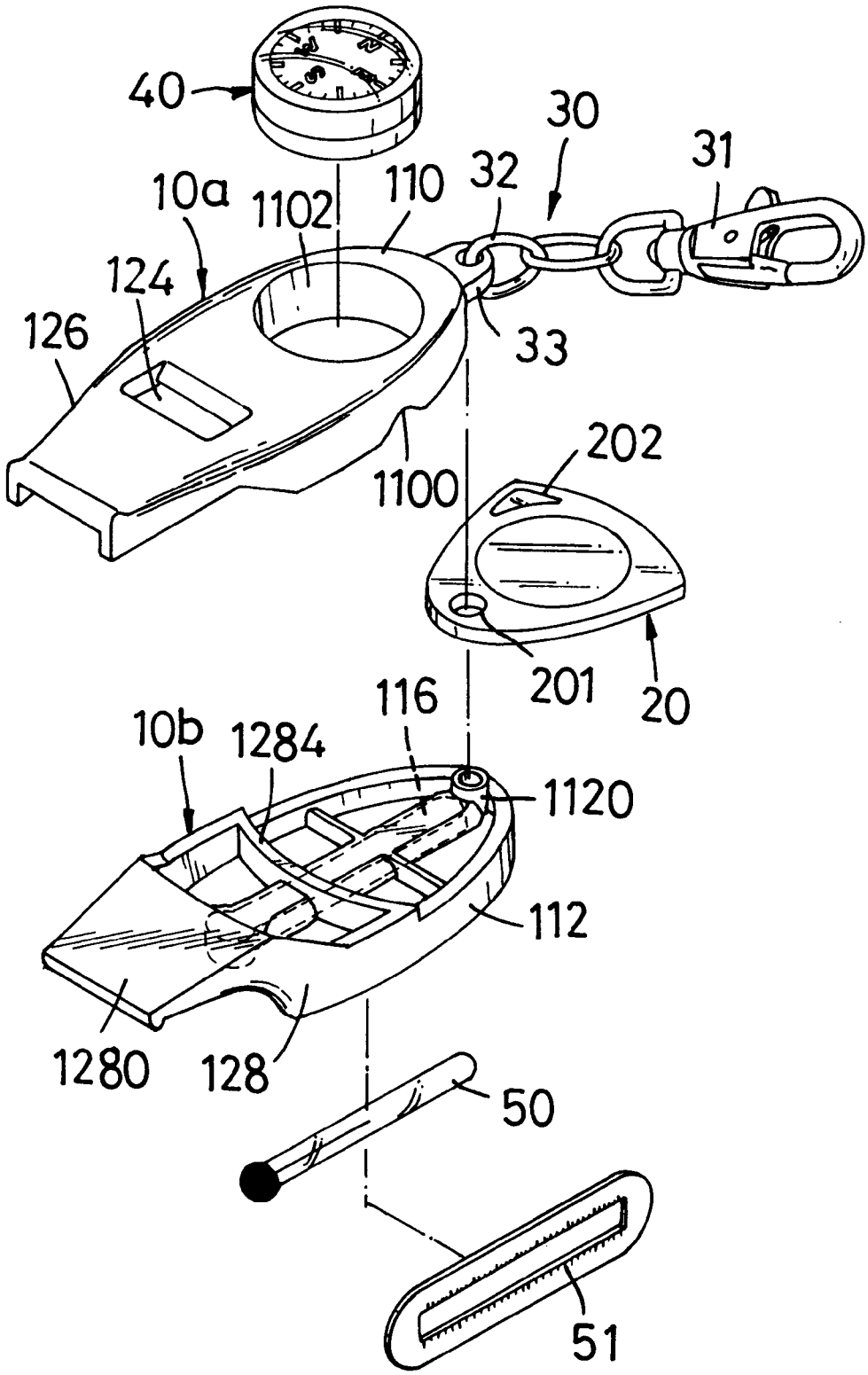
FIG. 2 is an exploded perspective view of the preferred embodiment.

Referring to FIGS. 1 to 3, in this embodiment, the casing 10 includes an upper casing wall 10*a* having the top part 110 of the front casing portion 11 and the upper part 126 of the rear casing portion 12 formed thereon, and a lower casing wall lob having the bottom part 112 of the front casing portion 11 and the lower part 128 of the rear casing portion 12 formed thereon. Preferably, the upper and lower casing walls 10*a*, 10*b*, which are complementary in construction, are made of plastic, such as ABS plastic, and are bonded integrally to each other, such as with the use of known high frequency bonding techniques.

The upper part 126 of the rear casing portion 12 has a generally inverted U-shaped cross-section. The air outlet 124 is rectangular in shape, and has a length that is transverse to the longitudinal axis. The air outlet 124 diverges from the bottom side to the top side of the upper part 126 of the rear casing portion 12 (see FIG. 3). The bottom part 112 of the front casing portion 11 is formed with a stub 1120 at one end of the front casing portion 11 distal to the rear casing portion 12. The top part of the front casing portion 11 is formed with a mounting socket 1110 that is registered with the stub 1120, as illustrated in FIG. 3.

The rear end 1280 of the lower part 128 of the rear casing portion 12 is in the form of a plate that inclines forwardly and upwardly, as shown in FIGS. 2 and 3. An upright shoulder 1281 is present at the juncture of the front and rear ends 1282, 1280 of the lower part 128 of the rear casing portion 12 such that the rear end 1280 is raised relative to the front end 1282. The front ends of the upper and lower parts 126, 128 are formed with upright curved walls 1264, 1284, in the form of a parabola, that define a front wall of the air chamber 120.

Figure 4:
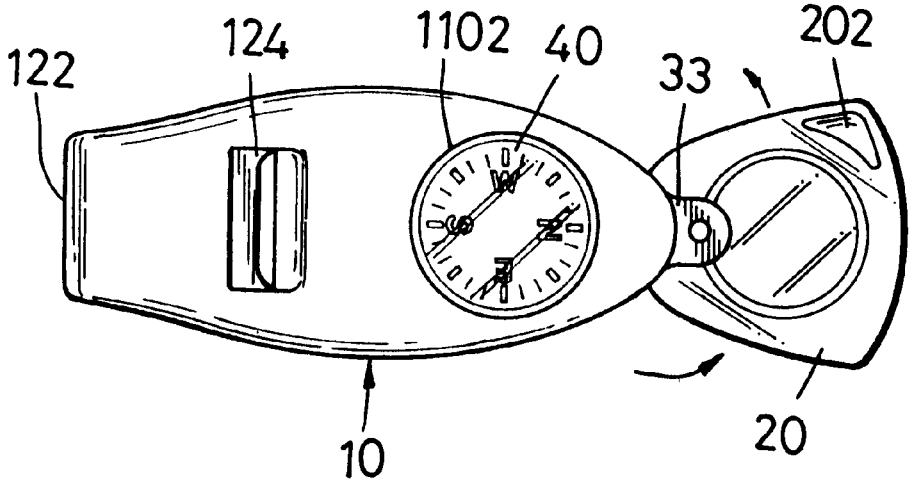
FIG. 4 is a top plan view illustrating the preferred embodiment in a state of use.

A planar magnifying lens piece 20 is disposed in the lens receiving space 114, and has an edge section mounted pivotally on the front casing portion 11. The lens piece 20 is movable between a concealed position, where the lens piece 20 is confined between the top and bottom parts 110, 112 of the front casing portion 11, as shown in FIG. 1, and an extended position, where the lens piece 20 is exposed from the top and bottom parts 110, 112 of the front casing portion 11, as shown in FIG. 4. In this embodiment, the stub 1120 extends through a hole 201 that is formed in the edge section of the lens piece 20, and engages the mounting socket 1110, thus permitting three hundred and sixty-degree rotation of the lens piece 20 relative to the front casing portion 11, as shown in FIG. 4.

The top part 110 of the front casing portion 11 has a notched periphery 1100 to facilitate moving of the lens piece 20 from the concealed position to the extended position. In addition, the lens piece 20 is formed with a dented surface 202 that is registered with the notched periphery 1100 to permit hooking of a fingernail thereon when the lens piece 20 is in the concealed position, thus further facilitating movement of the lens piece 20 to the extended position.

A key chain 30 has a key holding end 31 adapted for holding a bunch of keys (not shown) thereon, and a mounting end 32 opposite to the key holding end 31 and mounted on the casing 10. In this embodiment, at the end of the front casing portion 11 that is distal to the rear casing portion 12, there is provided a lateral ring projection 33 for engaging the mounting end 32 of the key chain 30.

The upper side of the top part 110 of the front casing portion 11 is formed with a receiving cavity 1102. A compass 40 is mounted in the receiving cavity 1102, such as with the use of an adhesive. In this embodiment, the compass 40 has an outer diameter that matches the diameter of the receiving cavity 1102.

The lower casing wall 10*b* further has a bottom side formed with a positioning cavity 116. A thermometer 50 is mounted in the positioning cavity 116, such as with the use of an adhesive. Preferably, the positioning cavity 116 is parallel to the longitudinal axis of the casing 10. In addition, a graduated retainer 51 is mounted on the bottom side of the lower casing wall lob to reinforce mounting of the thermometer 50 in the positioning cavity 116.

When camping, the lens piece 20 can be used to magnify objects, such as when inspecting plants or insects. In addition, when one gets lost or in case of danger, air can be blown via the air inlet 122 to generate a whistling sound for attracting the attention of other people. The compass 40 can be used to find one's way back to a campsite. The thermometer 50 can provide an indication of the ambient temperature so that the appropriate attire can be worn.

It has thus been shown that the multi-function key holder of the present invention provides a relatively large number of functions without substantially increasing its size to facilitate carrying of the same. The objects of the present invention are thus met.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A multi-function key holder, comprising:

a casing having a front casing portion which includes parallel top and bottom parts that extend forwardly and that are spaced apart vertically to define a lens receiving space therebetween, and a rear casing portion which extends rearwardly from said front casing portion and which confines an air chamber, said rear casing portion being formed with an air inlet adapted to permit blowing of air into said air chamber, and an air outlet adapted to permit releasing of the air that was blown into said air chamber, thereby permitting generation of a whistling sound output;

a planar magnifying lens piece disposed in said lens receiving space and having an edge section mounted pivotally on said front casing portion, said lens piece being movable between a concealed position, where said lens piece is confined between said top and bottom parts of said front casing portion, and an extended position, where said lens piece is exposed from said top and bottom parts of said front casing portion; and a key chain having a key holding end adapted for holding a bunch of keys thereon, and a mounting end opposite to said key holding end and mounted on said casing.

2. The multi-function key holder as claimed in claim 1, wherein said casing has a longitudinal axis that extends from said front casing portion to said rear casing portion, said air inlet being disposed on the longitudinal axis at one end of said rear casing portion distal to said front casing portion.

3. The multi-function key holder as claimed in claim 2, wherein said rear casing portion includes upper and lower parts having front ends that are connected to said front casing portion and rear ends that cooperatively define said air inlet, said air outlet being transverse to the longitudinal axis and being formed in said upper part.

4. The multi-function key holder as claimed in claim 3, wherein said rear end of said lower part of said rear casing portion is raised relative to said front end of said lower part of said rear casing portion.

5. The multi-function key holder as claimed in claim 3, wherein said casing includes an upper casing wall having said top part of said front casing portion and said upper part of said rear casing portion formed thereon, and a lower casing wall having said bottom part of said front casing portion and said lower part of said rear casing portion formed thereon.

6. The multi-function key holder as claimed in claim 5, wherein said upper and lower casing walls are made of plastic and are bonded integrally to each other.

7. The multi-function key holder as claimed in claim 5, wherein one of said top and bottom parts of said front casing portion is formed with a mounting socket, the other one of said top and bottom parts of said front casing portion is formed with a stub that extends through said edge section of said lens piece and that engages said mounting socket, thereby mounting pivotally said lens piece on said front casing portion.

8. The multi-function key holder as claimed in claim 1, wherein one of said top and bottom parts of said front casing portion has a notched periphery to facilitate moving of said lens piece from the concealed position to the extended position.

9. The multi-function key holder as claimed in claim 8, wherein said lens piece is formed with a dented surface that is registered with said notched periphery when said lens piece is in the concealed position.

10. The multi-function key holder as claimed in claim 1, wherein said edge section of said lens piece is mounted pivotally on one end of said front casing portion distal to said rear casing portion.

11. The multi-function key holder as claimed in claim 1, wherein said front casing portion has one end distal to said rear casing portion and formed with a lateral ring projection for mounting of said key chain thereon.

12. The multi-function key holder as claimed in claim 1, wherein said top part of said front casing portion has an upper side formed with a receiving cavity, said key holder further comprising a compass mounted in said receiving cavity.

13. The multi-function key holder as claimed in claim 1, wherein said casing has a bottom side formed with a positioning cavity, said key holder further comprising a thermometer mounted in said positioning cavity.

14. The multi-function key holder as claimed in claim 13, wherein said casing has a longitudinal axis that extends from said front casing portion to said rear casing portion, said positioning cavity being parallel to the longitudinal axis.

* * * * *